United States Patent [19]

Manola

[11] 4,398,759

[45] Aug. 16, 1983

[54] LITTER PICK UP DEVICE

[76] Inventor: Alvin J. Manola, 22 E. Whitehall, Northlake, Ill. 60164

[21] Appl. No.: 259,031

[22] Filed: Apr. 30, 1981

[51] Int. Cl.[3] ..... A01K 29/00

[52] U.S. Cl. ..... 294/1 BA; 294/19 R

[58] Field of Search ..... 294/1 BA, 11, 19 R, 294/20, 22, 50.8, 50.9, 100, 115

[56] References Cited

U.S. PATENT DOCUMENTS

| | | | |
|---|---|---|---|
| 465,222 | 12/1891 | Ulbricht | 294/19 R |
| 872,748 | 12/1907 | Putney | 294/19 R |
| 1,961,421 | 6/1934 | Hogenson | 294/115 |
| 2,199,300 | 4/1940 | Beletic | 294/11 |
| 2,616,741 | 11/1952 | Ziese | 294/19 R |
| 2,759,758 | 8/1956 | Yancey | 294/19 R X |
| 3,199,905 | 8/1965 | Johnson | 294/19 R X |
| 4,225,174 | 9/1980 | Hennessy et al. | 294/1 BA |

FOREIGN PATENT DOCUMENTS

| | | | |
|---|---|---|---|
| 2457526 | 6/1976 | Fed. Rep. of Germany | 294/1 BA |
| 739209 | 10/1955 | United Kingdom | 294/19 R |

*Primary Examiner*—Johnny D. Cherry

*Attorney, Agent, or Firm*—James J. Conlon; Paul A. Kerstein

[57] ABSTRACT

A portable, hand-held device for picking up litter and including a movable handle attached to a control cable which extends to a toggle mechanism which opens and closes a pair of pick-up jaws. A hollow rod extends between the handle and the jaws as a two piece member having a joint which allows the jaws and handle to be rotated with respect to one another to allow the device to pick up in any convenient direction. The control cable includes an adjustment lock which allows the distance between the jaws to be adjusted to thus adapt the pickup member for various types of litter.

5 Claims, 5 Drawing Figures

LITTER PICK UP DEVICE

BACKGROUND OF THE INVENTION (1) Field of the Invention

This invention pertains to a portable device for picking up litter and in particular, a device for picking up dog litter.

(2) Description of the Prior Art

A variety of devices have been provided in the past to pick up different types of litter and, in particular, to provide an ecological benefit by providing dog owners with a device to enable them to pick up after their dog. These devices are generally of two types. One is a shovel type of device which is slid under the litter, and thus picks up the litter for disposal. The second type of device involves those types of devices having movable jaws and some type of pistol grip operating handle. However, none of the devices known provide movable jaws in which the opening between the jaws can be adjusted, and whereby the amount of tension in a jaw-control spring may also be adjusted by simply varying the length of a control cable which extends from an operating handle to the jaws. Similarly, none of the prior art devices provides a two-piece handle allowing the lower section to be rotated with respect to the upperhandle section, to thus dispose the jaws in a variety of positions for easy pick up of litter. Thus, litter may be picked up when it is in inconvenient positions such as behind a bench or a tree, without the user having to contort himself or herself to arrange the jaws in a convenient position for pick-up. Also, the length of the pickup device can be adjusted easily because of the slip joint connection connecting the handle sections; thus the length can be adjusted from a length of approximately 30 inches in which it would resemble a cane to a shorter length of approximately 12 to 18 inches wherein the pickup device can be easily carried and transported.

SUMMARY OF THE INVENTION

This disclosure pertains to a litter pickup device and in particular, to a device for use by animal owners. The pickup device includes an elongated hollow tube, extending between a handle portion and a jaw portion wherein the tube is divided into two sections, and fitted together in such a fashion that the sections can be rotated with respect to one another. Also, the length of the tube can be adjusted by removal and replacement of the tube sections with longer or shorter sections, to thus customize the pickup device for use by various size users. The pickup device includes a handle portion providing a pivoted lever, having one end attached to a operating cable which is adjustable in length. The other end of the cable is attached to a toggle mechanism which operates a pair of jaws. By adjusting the length of the flexible cable, not only can the spacing between the jaws be adjusted, but also the tension in a jaw return spring can also be adjusted to vary the gripping force necessary to move the jaws. Because the hollow tube connecting the handle and jaws can be twisted, the angle between the handle and the jaws can be varied to thus allow litter to be picked up regardless of its orientation, with respect to the user. Also, by replacing the hollow tube sections with different length sections, the length of the pickup can be adjusted.

It is thus an object of this disclosure to provide a portable litter pickup device having a handle portion which can be easily operated to open and close pickup jaws, and an operating cable connecting the handle with a jaw linkage mechanism, in such a fashion that the length of the cable can be adjusted to vary the spacing between the jaws, and also to vary tension in a jaw return spring.

Another object of this disclosure is to provide a litter pickup device comprising a two-piece handle which allows the jaws to be oriented at various angles to the handle.

Yet another object is to provide a litter pickup device having a hollow tube and handle, which can be disassembled, and different length sections can replace existing sections to thereby vary the length of the device.

These and other objects of the disclosure will become apparent to those having an ordinary skill in the art with reference to the following description, drawings, and appended claims.

DETAILED DESCRIPTION OF THE DRAWINGS

Figure 1:
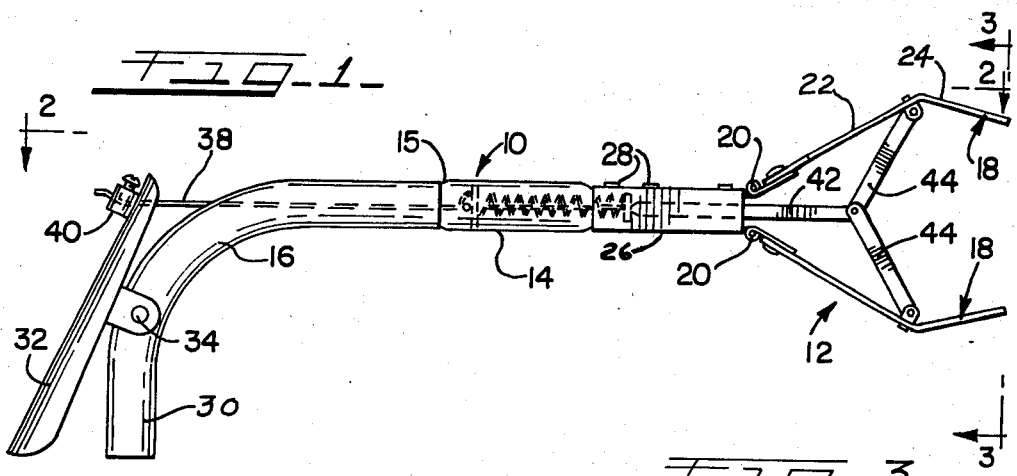
FIG. 1 is an elevational view of the device disclosed herein.
Figure 3:
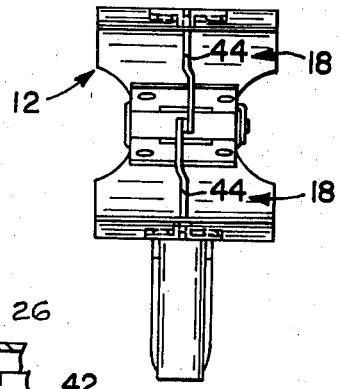
FIG. 3 is a view taken along lines 3—3 of FIG. 1.
Figure 4:
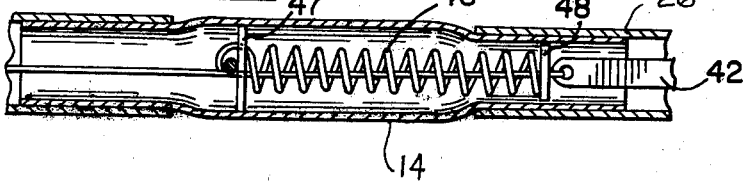
FIG. 4 is an enlarged view of the slip joint connecting the two tube portions showing a return spring.

Referring now to the drawings and in particular to FIG. 1, there is shown the portable litter pickup device disclosed herein, which is designated generally by the numeral 10. The pickup device 10 includes a scoop portion 12, which is connected to a lower shaft 14 by a slip connection 15. The lower shaft 14 is connected to a compatible upper shaft designated 16. As shown in FIG. 4, the lower shaft 14 includes a reduced end-portion which fits within a corresponding portion of the upper shaft 16, in such a fashion that the members are securely held together, but yet loose enough to allow relative rotation between the two shaft portions 14, 16.

Figure 2:
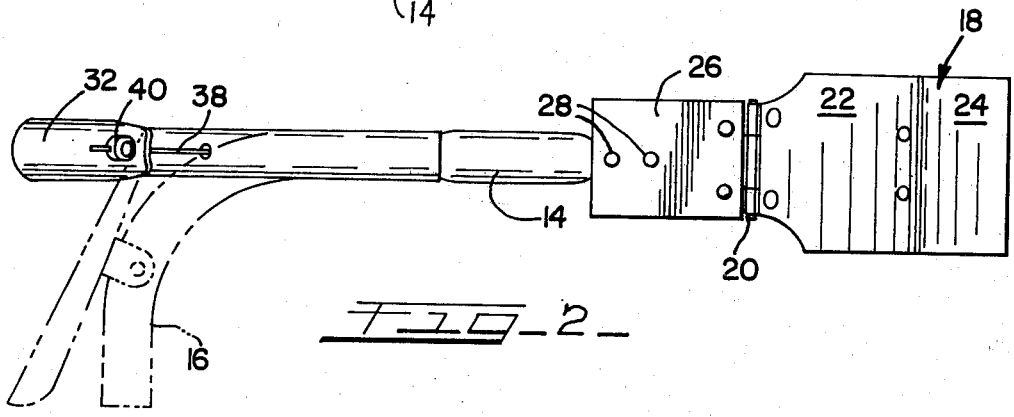
FIG. 2 is top view of the device illustrated in FIG. 1 with the rotational feature shown in phantom.

The scoop portion 12 includes a pair of jaws designated 18 which are arranged to open or close, and pivot about their associated hinges 20. As shown in FIG. 2, the jaws 18 include an inner jaw section 22 and an outer jaw section 24, designed in such a fashion that when the jaws are closed the outer jaw sections will come together to form an enclosure which securely grips and retains all types of litter. A box type of connector 26 provides a mounting for the hinges 20, and interconnects the jaws 18 with the lower shaft 14. A pair of fasteners 28, such as screws, rivets or the like, may be used to join the connector box 26 with the lower shaft 14.

Figure 5:
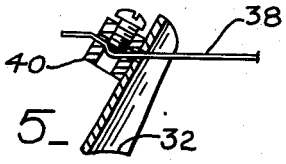
FIG. 5 is an enlarged, sectional view of the cable locking mechanism attached to the operating handle.

The upper portion of the portable pickup device includes a handle designated generally by the numeral 30. The handle includes a lever 32 pivoted about a pivot pin 34. The outer-end of the handle lever 32 contains an opening through which a control cable 38 is fitted. As shown in FIG. 5, cable 38 is adjustably held in place on the outer-end of the handle lever 32, by a lock device 40 which may be of any convenient design, but is shown here as a lock screw threaded into a short tubular member which is welded or otherwise attached to the handle 32.

The other end of cable 38 is attached to a toggle link 42 (FIG. 1), which in turn is connected to a pair of outwardly extending toggle arms 44, which are attached to associated jaws 18. A return spring 46 is located in the shaft and one end abuts a stop 47, which is securely attached in the shaft section 14. The other end of the return spring 46 is attached to a movable or floating stop 48 located adjacent toggle link 42. Thus, as the handle 32 (as shown in FIG. 1) is rotated counter clockwise, the floating stop 48 will move towards the fixed stop 47 and compress the return spring 46. At the same time, the toggle link 42 and the associated mechanism toggle arms 44 will cause the jaws 18 to move together to pick up litter. As the handle lever 32 is released the compression spring 46 will expand causing the toggle arms 44 to force open the jaws 18 and release litter.

As shown in the illustrations, relative rotation between the lower shaft 14 and upper shaft 16 is permitted because of the slip joint connection 15. Thus, the handle can be moved 360 degrees with respect to the jaws 18. For purposes of illustration, a 90 degree rotation of the handle with respect to the jaws 18 is shown in FIG. 2. This feature is provided to allow the user to orient the handle with respect to the jaws rather than contort his or her body to adapt to the location and arrangement of the litter which is to be picked up. Similarily, when litter is to be removed it is often times more convenient to maintain the handle in a pistol-like grip and rotate the jaws 90 degrees to allow the jaws to be tapped against the side of a litter container to insure that all the litter is removed from the jaws.

Another feature provided by this slip joint connection 15 and the adjustable length cable 38 is that the length of the upper shaft 16 can be adjusted; thus, the device can utilize a very short shaft 16 and handle 32 and be very highly portable and unobtrusive. By the same token, a spare handle and upper shaft 16 can be utilized with a longer flexible cable 38 to allow the length of the unit to be significantly expanded, to a length of 30 to 36 inches, for example.

It has thus, been shown by the foregoing that the portable pickup device disclosed herein provides a number of features such as ease of portability, ease of operation, and manufacture and interchangeability of parts to adjust the length of the device.

The foregoing description and drawings merely explain and illustrate the invention, and the invention is not limited thereto, except insofar as the appended claims are so limited, as those who are skilled in the art and have the disclosure before them will be able to make modifications and variations therein without departing from the scope of the invention.

What is claimed is:

1. A portable pick-up device for engaging, grasping, encompassing and disposing of animal litter, in particular, dog litter, the improvement comprising:

a handle having an operating lever pivotally connected thereto and adapted to pivot upon engagement by a user;

a shaft comprising hollow tube means extending from the handle;

jaw means with portions adapted to move between an open and closed position extending from said shaft;

an operating mechanism comprising a cable attached at one end to the operating lever, and having a second end;

toggle link means interconnected between the second end of said cable and said jaw means;

spring means for engaging the cable and biasing the jaw means into said open position by acting directly on said toggle link means and said cable;

lock means mounted on said lever cooperative with the cable for selective adjustment of the length of the cable thereby enabling the adjustment of the opening of the jaw means;

said shaft includes first and second hollow tube portions;

a friction slip connection comprising a reduced diameter portion on said first tube portion insertable within the second hollow tube portion to allow for relative rotation between the two tube portions; and said friction slip connection being biased together by the force of said spring means acting on said toggle link means and the adjustment of said cable provided by said lock means.

2. The litter pick-up device of claim 1 wherein said shaft comprises:

a removable handle portion having means disengageable from the cable to pivot the handle to be replaced by a handle having a different length to thereby vary the length of the litter pick-up device.

3. The litter pick-up device of claim 1 and:

a connector box having means attached to said shaft and including hinge means for mounting said jaw means.

4. The litter pick-up device of claim 3 wherein said toggle link means includes:

a toggle link having one end connected with said cable;

a pair of toggle arms connected with and diverging from the toggle link and having means connected with the jaw means, whereby pivoting movement of the operating lever moves the jaw means between open and closed positions.

5. The litter pick-up device of claim 1 wherein said spring means comprise:

stop means having means fixed to prevent movement;

coil spring means having one end in abutment with said stop means;

floating stop means at the other end of the spring means and having means movable with said cable whereby tightening of the cable urges the floating and fixed stop means together to compress the coil spring means, and, release of the cable allows the spring means to automatically urge the jaw means apart.

* * * * *